United States Patent [19]

Morell

[11] Patent Number: 4,974,855

[45] Date of Patent: Dec. 4, 1990

[54] GOLF BALL

[75] Inventor: Joseph Morell, Annecy, France

[73] Assignee: Salomon S.A., Annecy, France

[21] Appl. No.: 441,818

[22] Filed: Nov. 27, 1989

[30] Foreign Application Priority Data

Nov. 29, 1988 [FR] France ..... 88 15571

[51] Int. Cl.[5] ..... A63B 37/14

[52] U.S. Cl. ..... 273/232; 40/327

[58] Field of Search ..... 273/232

[56] References Cited

U.S. PATENT DOCUMENTS 4,772,026 9/1988 Gobush ..... 273/232

4,844,472 7/1989 Ihara ..... 273/232

FOREIGN PATENT DOCUMENTS 735555 11/1932 France ..... 273/232

2555061 5/1985 France ..... 273/232

189551 12/1922 United Kingdom ..... 273/232

*Primary Examiner*—George J. Marlo

[57] ABSTRACT

The present invention relates to a golf ball. In order to improve the indifferent character of the orientation of the ball with respect to the strike, the peripheral surface (2) of it has dimples (69) essentially distributed inside 48 identical elemental surfaces (68), in the form of spherical right-angle triangles, delimited by 9 equatorial circles (56 to 61, 65 to 67) of the sphere defining the general shape of the peripheral surface (2) of the ball (3).

8 Claims, 1 Drawing Sheet

GOLF BALL

The present invention relates to a golf ball of the type having a peripheral surface having the general shape of a sphere and a plurality of dimples arranged in the said peripheral surface and distributed on the latter in accordance with at least one repetititive motif, at least essentially inside elemental spherical surfaces defined by sub-division of the said peripheral surface along arcs of circles centered on the centre of the sphere and mutually connecting points of the peripheral surface corresponding to points determined by a cube inscribed in the sphere.

A golf ball of this type is described in French patent No. 735,555, and more precisely with reference to FIGS. 14 to 18 of this document; with reference to these figures, this latter recommends the sub-division of each of the six faces of the cube into four principal triangles of which each is divided into 9, or 16, or 60 triangles determining the positions of the dimples.

This known mode of sub-division of the peripheral surface of a golf ball has an inconvenience in that the behaviour of the latter in its trajectory is narrowly tied to the orientation of the ball with respect to the strike; in effect, even if the dimples are arranged with the same motif in the 24 elemental surfaces, in spherical triangular form, resulting from the sub-division of each of the faces of the cube into four principal triangles, the probability of successive strikes hitting the peripheral surface of the ball in its zones having different geometries is significant; in other words, unless great care is taken in the positioning of the ball before the strike, in a manner difficult to practically envisage, a ball having the distribution of dimples recommended with reference to FIGS. 14 to 18 of French patent No. 735,555 will not lend itself to suitable reproduceability of strikes, and consequently of trajectories.

The object of the present invention is to remedy this inconvenience by proposing, also from a cube inscribed inside the sphere, a finer sub-division of the surface of this, in order to increase the homogeneity of distribution of the dimples and consequently to obtain a characteristic as indifferent as possible to the orientation of the ball with respect to the strike.

To this end, the ball of the invention, of the type indicated in the preamble, is characterised in that the sub-division is carried out along:

6 equatorial circles of which each is centred on an axis passing through the respective mid-points of two diametrically opposed edges of the cube and passes through 4 apices of the latter, 3 equatorial circles of which each is centred on an axis passing through the respective centres of two diametrically opposed faces of the cube and passes through the radial projections, onto the sphere, of respective mid-points of 4, mutually parallel, edges of the cube, in a manner to define 48 identical elemental surfaces in spherical right-angle triangle form.

With respect to the disposition described in the mentioned French patent, the number of elemental surfaces is doubled, which doubles the probability of an identical relative orientation of a dimple and of the strike for successive strikes; preferably, the dimples are distributed according to an identical motif in each of the elemental surfaces, which again increases this probability, but the scope of the present invention will not be departed from by providing other arrangements in this regard, and particularly in providing more disposition motifs for the dimples in the elemental surfaces, each motif being attributed to some elemental surfaces regularly distributed on the sphere.

Particularly for reasons of ease of manufacture, it is preferred that at least one determined equatorial circle, amongst the said equatorial circles, cuts none of the dimples; this determined circle can correspond to a joint plane when the ball is manufactured by assembly of two identical halves or when at least one surface layer of it, including the dimples, is made by moulding in a single piece in a mould itself formed of two assembled identical halves; taking account of the fine sub-division of the peripheral surface of the ball and of the homogeneity of distribution of the dimples which results, one can then allow one of the halves of the ball or of the mould, respectively, possibly to be angularly displaced with respect to the other half about the axis of the said determined equatorial circle; in this case, the said determined equatorial circle sub-divides each of the other said equatorial circles into two circular arcs, of which each corresponds to one of two hemispheres defined by the said determined equatorial circle, and the circular arcs of one of the hemispheres are angularly displaced, with respect to the respectively corresponding circular arcs of the other of the hemispheres, by the same amount about the axis of the said determined equatorial circle; the fact of allowing such a disposition considerably eases the manufacture of the ball by assembly of two halves or by moulding in a mould formed of two assembled halves, because it is not necessary to perform a precise adjustment of the relative angular position of the two halves of the ball or of the mould, respectively, in manufacture of the ball.

Other characteristics and advantages of a ball according to the present invention will appear from the description below, relating to two non-limitative embodiments, as well as from the accompanying drawing which forms an integral part of this description.

Figure 1:
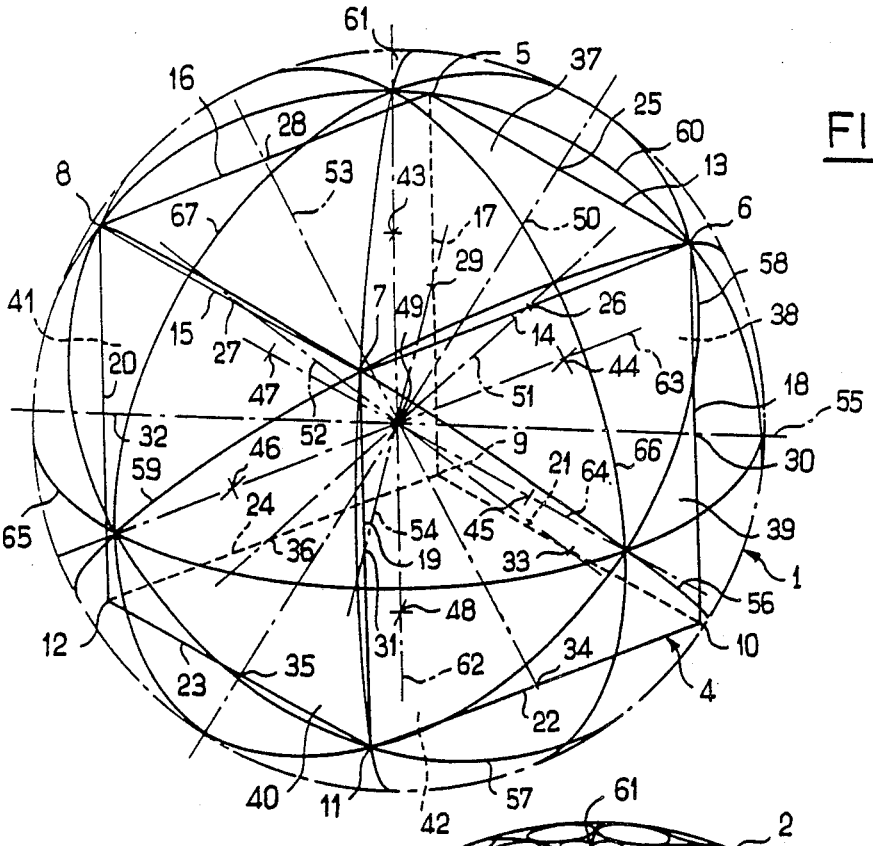
FIG. 1 illustrates the construction, in accordance to the method of the more general embodiment of the present invention, of 9 equatorial circles on a sphere from a cube inscribed in this latter.
Figure 2:
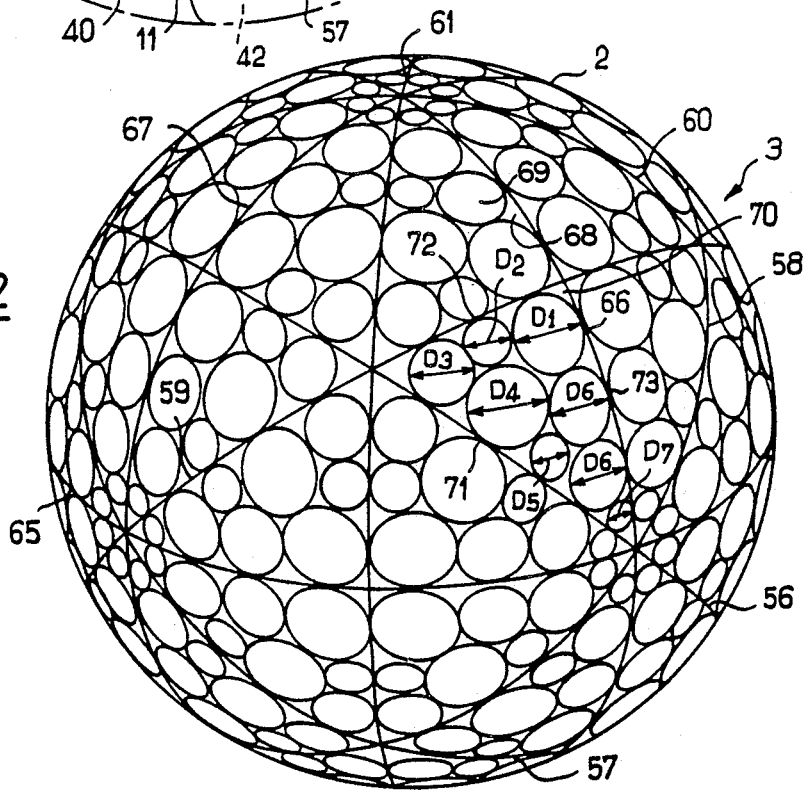
FIG. 2 shows a golf ball of which the dimples are distributed in the 48 identical elemental surfaces, in spherical right-angle triangle form, obtained by this sub-division by means of 9 equatorial circles.

Referring in the first place to FIG. 1 where there is designated by 1 a sphere producing the general shape of the peripheral surface 2 of a golf ball 3 illustrated in FIG. 2, and by 4 a cube inscribed in this sphere 1 on which there are 8 apices 5 to 12 connected in pairs by 12 edges 13 to 24 of which each has a mid-point 25 to 36 and which, in fours, define six square faces 37 to 42 of which each has a centre 43 to 48; the cube 4 itself and the sphere 1 have a common centre 49 which will serve as a reference when reference is made below to the concept of diametrically opposed positions or of radial projection.

For geometrical reasons, the edges 13 to 24 of the cube 4 are distributed in 6 groups of two mutually parallel, diametrically opposed edges, that is to say edges 13 and 23, 14 and 24, 15 and 21, 16 and 22, 17 and 19, 18 and 20 of which the respective mid-points also occupy diametrically opposed positions; in accordance with the present invention, by means of the respective mid-points of two edges also diametrically opposed, axes are determined, that is to say the axis 50 passing through the mid-points 25 and 35, the axis 51 passing through the mid-points 26 and 36, the axis 52 passing through the mid-points 27 and 33, the axis 53 passing through the mid-points 28 and 34, the axis 54 passing through the mid-points 29 and 31, and the axis 55 passing through the mid-points 30 and 32; around 6 of the axes thus determined, in a plane (not referenced) perpendicularly cutting this axis at the centre 49 of the cube 4 and of the sphere 1, is traced on this sphere 1 an equatorial circle passing through 4 apices of the cube, that is to say the circle 56 having the axis 50, passing through the apices 7, 8, 9, 10, the circle 57 having the axis 51, passing through the apices 5, 10, 11, 8, the circle 58 having the axis 52, passing through the apices 5, 6, 11, 12, the circle 59 having the axis 53, passing through the apices 6, 7, 12, 9, the circle 60 having the axis 54, passing through the apices 6, 10, 12, 8 and the circle 61 having the axis 55, passing through the apices 5, 9, 11, 7; these six circles 56 to 61 are also represented on the peripheral surface 2 of the ball 3 in FIG. 2, but it will be noted that it is not necessary for these circles to be materially reproduced on this surface 2.

Also for geometrical reasons, the respective centres of two diametrically opposed faces of the cube 4 are divided into three groups of two diametrically opposed centres, that is to say centres 43 and 48, 44 and 46, 45 and 47; in accordance with the present invention, there is defined by the two centres of each of these groups an axis, respectively 62, 63, 64, and about this axis there are described on the sphere respective equatorial circles 65, 66, 67; the circle 65 with the axis 62 cuts the circles 57, 59, 60 on the axis 63, that is to say in the region of radial projections onto the surface of the sphere of centres 44 and 46 of the faces 38 and 40; the circle 66 cuts the circles 56 and 58 as well as the circle 65 on the axis 64, that is to say in the region of radial projections onto the sphere of the centres 45 and 47 of the faces 39 and 41; the circle 67 with the axis 64 cuts the circles 60 and 61 as well as the circle 66 on the axis 62, that is to say in the region of the radial projections onto the sphere of the centres 43 and 48 of the faces 37 and 42.

The three equatorial circles 65, 66, 67 have been represented on the peripheral surface 2 of the ball 3 in FIG. 2, although they need not necessarily be reproduced on this latter.

It should be noted that, for geometrical reasons, each of the nine equatorial circles 56 to 61 and 65 to 67 defines by its own plane (not referenced) a plane of symmetry for the eight other equatorial circles.

As appears more particularly from FIG. 2, the 9 equatorial circles thus defined delimit between them, in threes, identical elemental surfaces such as 68 of which each has a spherical right-angle triangle form of which there is designated the right angle by 70, teh hypothenuse by 71, a small side adjacent the right angle 70 by 72, and a large side adjacent the right angle 70 by 73.

In each of these identical elemental surfaces 68 are distributed, in accordance with a motif here identical, dimples such as 69 here 8 in number per elemental surface 68; the number of dimples 69 thus arranged in an elemental surface 68 as well as the motif in accordance with which these dimples are arranged in this elemental surface 68, and the concrete form of these dimples 69 here in the form of part-spherical depressions can be varied in large measure without departing from the scope of the present invention; it should be noted that when the motif in accordance with which the dimples such as 69 are thus distributed in the different elemental surfaces such as 68 is identical, the respective planes of the equatorial circles 56 to 61 and 65 to 66 also constitute planes of symmetry for the dimples such as 69, so that the ball 3 as a whole then has symmetry about the 9 planes.

More precisely, in the non-limitative example illustrated, the dimples such as 69 define by their inter-section with the peripheral, spherical surface of the ball with a diameter of the order of 42.67 mm, circles distributed in the following manner in each elemental surface such as 68:

one circle of diameter $D_1$ of the order of 2.45 mm positioned in the right angle 70 and approximately tangential to the two sides 72 and 73 of the right angle 70, one circle of diameter $D_2$ of the order of 1.40 mm, approximately tangential to the circle of diameter $D_1$ and to the small side 72 of the right angle 70, one circle of diameter $D_3$ of the order of 1.90 mm, approximately tangential to the circle of diameter $D_2$, to the small side 72 of the right angle 70 and to the hypothenuse 71, one circle of diameter $D_4$ of the order of 2.50 mm, approximately tangential to the circles of diameter $D_2$ and $D_3$ and to the hypothenuse 71, one circle of diameter $D_5$ of the order of 1.38 mm, approximately tangential to the circle of diameter $D_4$ and to the hypothenuse 71, two circles of diameter $D_6$ of the order of 2.10 mm, of which the first is approximately tangential to the circles of diameter $D_1$, $D_4$ and $D_5$ and the large side 73 of the right angle 70, and of which the second is approximately tangential to the first, to the circle of diameter $D_5$ to the large side 73 of the right angle 70 and to the hypothenuse 71, one circle of diameter $D_7$ of the order of 0.97 mm, approximately tangential to the second circle of diameter $D_6$ to the large side 73 of the right angle 70 and to the hypothenuse 71.

With reference to the peripheral, spherical surface of the ball, each of the dimples such as 69 has in this non-limitative example a depth increasing with the diameter of its intersection with the peripheral surface 2, that is to say a depth of the order of 0.1 mm, for the dimples such as 69 corresponding to the mentioned circles of smallest diameter, to 0.5 mm for the dimples such as 69 corresponding to the mentioned circles of greatest diameter; as for the values of the diameters $D_1$, $D_2$, $D_3$, $D_4$, $D_5$, $D_6$, $D_7$, these values of depth are given by way of non-limitative example only.

The dimples 69 cut none of the equatorial circles 56 to 61 and 65 to 67 in the illustrated example.

Possibly in a non-illustrated manner, one could permit certain of the dimples such as 69 to overlap the immediately neighbouring equatorial circles - amongst the equatorial circles 56 to 61 and 65 to 67; preferably, however, one at least of the equatorial circles cuts none of the dimples such as 69, to correspond with a joint plane between two halves of the ball if it is made in two halves, or between two halves of a mould intended for the production of the ball, or at least of a surface layer of the latter having the dimples, in a single piece by moulding; in a non-illustrated manner, this determined equatorial circle can sub-divide each of the other equatorial circles into two circular arcs mutually angularly displaced, by the same amount, about the axis of this equatorial circle, which will certainly cause the disappearance of the mentioned symmetries but is not really harmful to the homogeneity of distribution of the dimples such as 69 on the peripheral surface 2 of the ball 3.

In a general manner, the present invention is susceptible of numerous variants without departing from its scope.

I claim:

1. A golf ball comprising a peripheral surface having a general shape of a sphere and a plurality of dimples arranged in said peripheral surface and distributed on the latter in accordance with at least one repetitive motif defined by sub-division of said peripheral surface along arcs of equatorial circles centred on a centre of said sphere and mutually connecting points of said peripheral surface corresponding to determined points of a cube inscribed in said sphere, said circular arcs defining elemental spherical surfaces and said dimples being essentially inside said elemental surfaces, wherein said sub-division is carried out along:

6 said equatorial circles of which each is centred on an axis passing through respective mid-points of two diametrically opposed edges of said cube and passes through four apices of the latter, 3 said equatorial circles of which each is centred on an axis passing through respective centres of two diametrically opposed faces of said cube and passes via radial projections, onto said surface, of respective mid-points of 4 mutually parallel edges of said cube, in a manner to define 48 identical elemental surfaces in spherical right-angle triangle form.

2. A golf ball according to claim 1, wherein at least a determined one of said equatorial circles cuts none of said dimples.

3. A golf ball according to claim 2, wherein said determined equatorial circle sub-divides each of the other said equatorial circles into two circular arcs, of which each corresponds to one of two hemispheres defined by said determined equatorial circle, and said circular arcs of one of said hemispheres are angularly displaced, with respect to respectively corresponding ones of said circular arcs of the other of said hemispheres, by the same amount about an axis of said determined equatorial circle.

4. A golf ball according to claim 2, wherein none of said equatorial circles cuts one of said dimples.

5. A golf ball according to claim 1, wherein said dimples are distributed in accordance with an identical motif in said identical elemental surfaces.

6. A golf ball according to claim 5, wherein said sphere has a diameter of the order of 42.67 mm, and said dimples define by their intersection with said peripheral surface circles distributed in the following manner in each said elemental surface of spherical right-angle triangle form, of which the right angle is situated between two sides of different length:

one circle of diameter $D_1$ of the order of 2.45 mm, positioned in said right angle and approximately tangential to said two sides of said right angle, one circle of diameter $D_2$ of the order of 1.40 mm, approximately tangential to said circle of diameter $D_1$ and to a smaller of said sides of said right angle, one circle of diameter $D_3$ of the order of 1.90 mm, approximately tangential to said circle of diameter $D_2$ to said smaller side of said right angle and to a hypothenuse, opposite said right angle, one circle of diameter $D_4$ of the order of 2.50 mm, approximately tangential to said circles of diameter $D_2$ and $D_3$ and to said hypothenuse, one circle of diameter $D_5$ of the order of 1.38 mm, approximately tangential to said circle of diameter $D_4$ and to said hypothenuse, two circles of diameter $D_6$ of the order of 2.10 mm, of which a first is approximately tangential to said circles of diameter $D_1$, $D_4$ and $D_5$ and to a larger of said sides of said right angle and of which a second is approximately tangential to said first, to said circle of diameter $D_5$ and to said larger side of said right angle and to said hypothenuse, one circle diameter $D_7$ of the order of 0.97 mm approximately tangential to a second one of said circles of diameter $D_6$, to said larger side of said right angle and to said hypothenuse.

7. A golf ball according to claim 6, wherein each said dimple has a depth of the order of 0.1 mm to 0.5 mm increasing with correspondingly increasing diameter of its said circle.

8. A golf ball according to claim 1, wherein each dimple is shaped as a spherical depression.

* * * * *